US009421608B2

(12) United States Patent
Loudenslager et al.

(10) Patent No.: US 9,421,608 B2
(45) Date of Patent: Aug. 23, 2016

(54) GOLF BAGS, TOP DIVIDERS FOR GOLF BAGS AND METHODS OF MAKING TOP DIVIDERS

(75) Inventors: John H. Loudenslager, Phoenix, AZ (US); Brian J. McGuire, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 82 days.

(21) Appl. No.: 13/587,195

(22) Filed: Aug. 16, 2012

(65) Prior Publication Data

US 2013/0043153 A1 Feb. 21, 2013

Related U.S. Application Data

(60) Provisional application No. 61/525,511, filed on Aug. 19, 2011, provisional application No. 61/678,322, filed on Aug. 1, 2012.

(51) Int. Cl.
*B22D 17/00* (2006.01)
*A63B 55/00* (2015.01)

(52) U.S. Cl.
CPC ..... *B22D 17/00* (2013.01); *A63B 55/00* (2013.01); *A63B 55/40* (2015.10)

(58) Field of Classification Search
CPC ..... B22D 17/00; A63B 55/00; A63B 55/40
USPC ..... 206/315.3, 315.6
See application file for complete search history.

(56) References Cited

U.S. PATENT DOCUMENTS

| | | | | | |
|---|---|---|---|---|---|
| 3,777,498 | A * | 12/1973 | Andrews et al. | 405/185 |
| 3,799,227 | A * | 3/1974 | Cantwell | 224/613 |
| 4,055,207 | A * | 10/1977 | Goodwin | 206/315.6 |
| 4,767,001 | A * | 8/1988 | Kim | 206/315.3 |
| 5,042,704 | A * | 8/1991 | Izzo | 224/643 |
| 5,178,273 | A * | 1/1993 | Igarashi | 206/315.7 |
| 5,450,955 | A * | 9/1995 | Olson | 206/315.6 |
| 5,671,842 | A * | 9/1997 | Jaworski | 206/315.3 |
| 6,021,895 | A * | 2/2000 | Wu | 206/315.3 |
| 6,126,050 | A * | 10/2000 | Aliano, Jr. | 224/274 |
| 6,199,690 | B1 * | 3/2001 | Shin | 206/315.3 |
| 6,330,944 | B1 * | 12/2001 | DeMichele | 206/315.3 |
| 6,478,203 | B2 | 11/2002 | Burns | |
| 6,488,191 | B1 | 12/2002 | Suggs et al. | |
| 6,640,970 | B1 * | 11/2003 | Townsend, Jr. | 206/315.2 |
| D517,808 | S * | 3/2006 | Reimers et al. | D3/320 |
| 7,124,887 | B2 | 10/2006 | Reimers | |
| 7,216,762 | B2 | 5/2007 | Chen | |
| 7,431,155 | B2 * | 10/2008 | Kadoya | 206/315.6 |
| D632,890 | S * | 2/2011 | Reimers | D3/255 |
| 2005/0092630 | A1 * | 5/2005 | Chen | 206/315.6 |
| 2006/0022418 | A1 * | 2/2006 | Ortega | 280/47.26 |
| 2011/0303568 | A1 * | 12/2011 | Reimers et al. | 206/315.6 |
| 2012/0111747 | A1 | 5/2012 | Reimers | |
| 2013/0075290 | A1 * | 3/2013 | Chang | 206/315.6 |

* cited by examiner

*Primary Examiner* — Tri Mai

(57) ABSTRACT

Embodiments of golf bags, top dividers for golf bags and methods of making top dividers are generally described herein. Other embodiments may be described and claimed.

7 Claims, 12 Drawing Sheets

GOLF BAGS, TOP DIVIDERS FOR GOLF BAGS AND METHODS OF MAKING TOP DIVIDERS

RELATED APPLICATIONS

The present application claims the benefit of the filing date of U.S. Provisional Application Ser. No. 61/525,511, filed Aug. 19, 2011, and claims the benefit of the filing date of U.S. Provisional Application Ser. No. 61/678,322, filed Aug. 1, 2012, the entire disclosures of which are expressly incorporated herein by reference.

FIELD

The present application generally relates to golf bags, and more particularly, to golf bags, top dividers for golf bags and methods of making top dividers.

BACKGROUND

Golf bags are used to carry golf clubs and accessories. Typical golf bags are generally tube-shaped to hold golf clubs and include one or more pockets for holding balls, tees, gloves, rain gear, and other golf related equipment and accessories. The open top of a golf bag is typically divided into a number of slots to allow an individual to organize and sort the clubs. Certain golf bags, such as staff bags are taller and have a larger circumference than a typical golf bag. The larger size of staff bags allows inclusion of more pockets and storage areas for carrying more equipment and accessories. For this reason, staff bags are used by tournament players so that that a large number of equipment, accessories and even food can be carried, for several hours. Additionally, the large external surface area of a staff bag can be used for displaying advertisements, logos, and other visual information. Staff bags also include an open top that is divided into a number of slots to allow an individual to organize and sort the clubs.

DESCRIPTION

Figure 1:
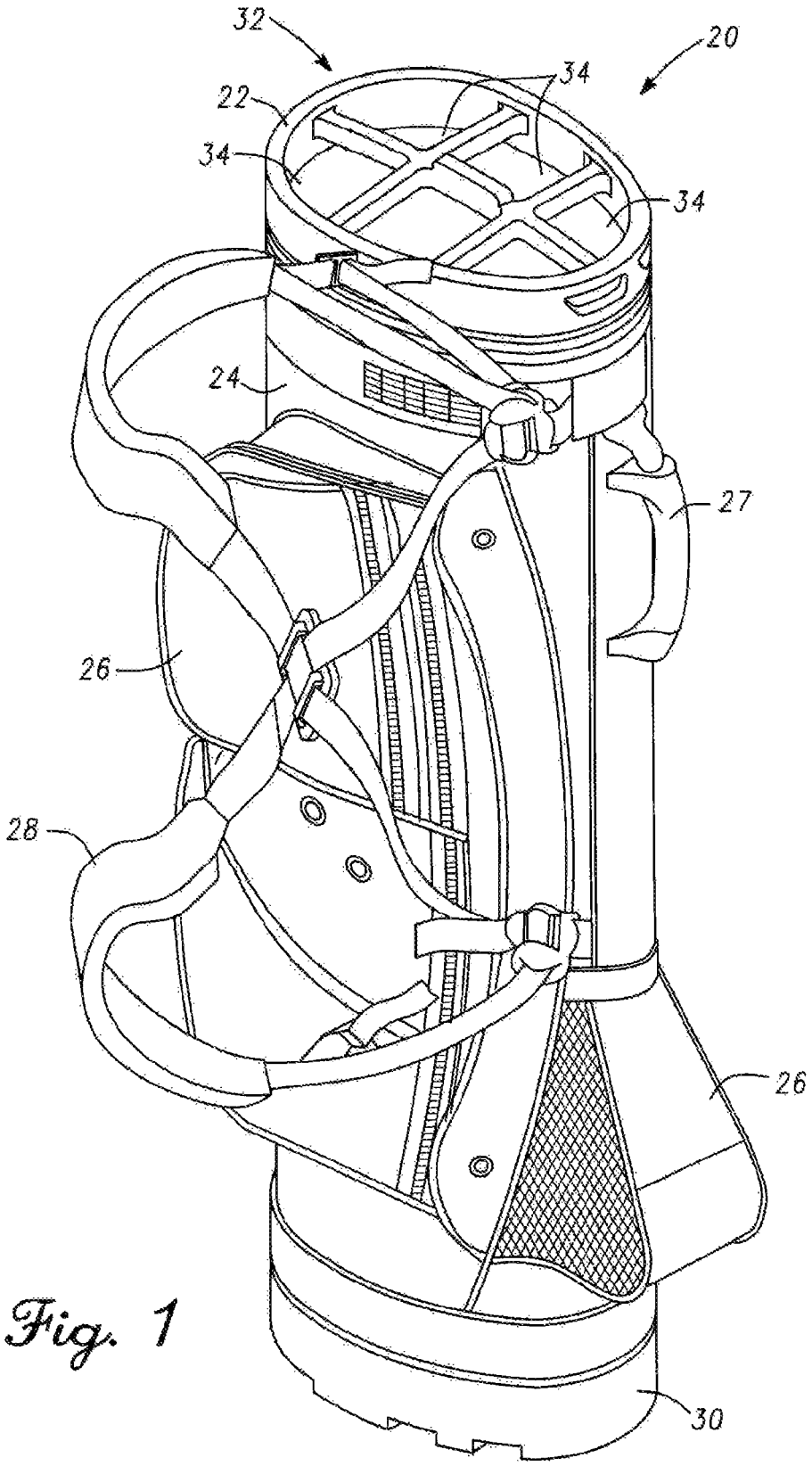
FIG. 1 shows a golf bag according to one embodiment.
Figure 2:
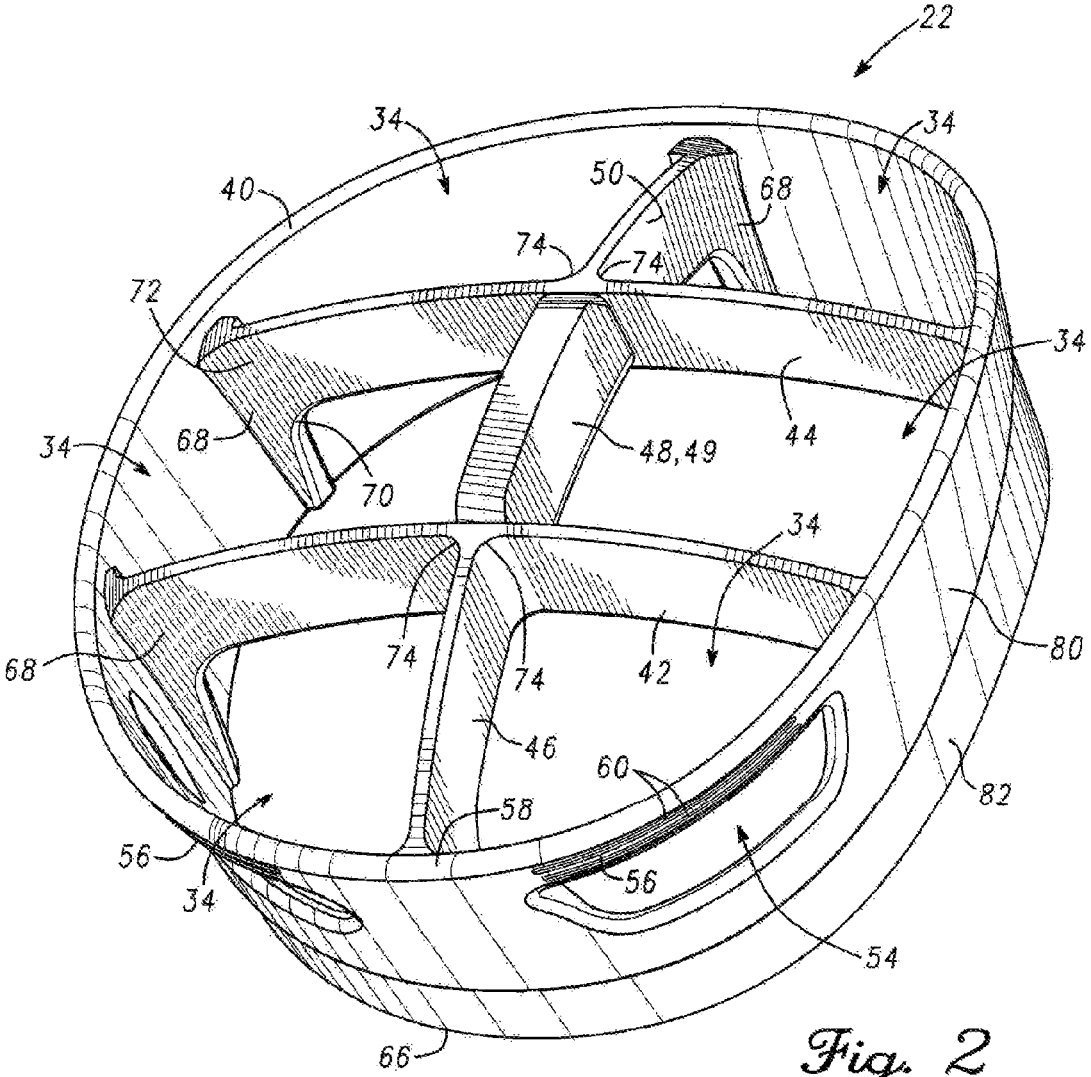
FIG. 2 shows a top perspective view of a top divider according to one embodiment.

Referring to FIG. 1, a golf bag 20 having a top divider 22 according to an exemplary embodiment is shown. The golf bag 20 includes a body 24 and may include one or more pockets 26, one or more handles 27, and one or more adjustable straps 28. The golf bag 20 includes a closed bottom end 30 and an open top end 32. The top divider 22 is located at the open top end 32 and includes a plurality of slots 34, which are described in more detail below, to allow sorting and/or organizing of golf clubs when being placed inside the golf bag. The golf bag 20 may be a carry bag, a cart bag, a staff bag, or any type of bag that may be used for carrying golf clubs. The body 24 of the golf bag 20 may be constructed from a soft shell, a hard shell, or a combination thereof. The top divider 22 may be constructed in one piece and include, one or more integrated handles for carrying the golf bag 20. Alternatively, the top divider 22 may be constructed in two or more pieces. Further, one or more handles (e.g., one handle 27 is shown in FIG. 1) may be attached or affixed to the golf bag 20. An individual who is using the golf clubs stored in the golf bag 20 may also carry the golf bag. Alternatively, another individual such as a golf caddie may carry the golf bag. An individual who may lift, move, or shift the golf bag 20 may be generally referred to herein as a carrier.

Referring to FIGS. 2-8, the top divider 22 includes a perimeter section 40, the shape of which may define the shape of the open top 32 of the golf bag 20. The top divider 22 further includes a plurality of interconnected ribs (e.g., generally shown as ribs 42, 44, 46, 48, and 50) located inside and connected to the perimeter section 40. The interconnected ribs form a grid like structure to define the slots 34. In the exemplary embodiments according to the disclosure, the top divider 22 includes two lateral ribs 42 and 44 and three longitudinal ribs 46, 48 and 50 that divide the space in the perimeter section 40 into six slots 34. The number of ribs and the resulting number of slots and the arrangement of the ribs relative to each other is exemplary and does not in any way limit various rib and slot configurations for dividing the open top 32. For example, the top divider 22 may include a plurality of ribs that are radially arranged and are interconnected at the center of the open top 32. Accordingly, such ribs may define pie-shaped slots in the open top 32. Therefore, having any number of ribs in any configuration to provide any number of openings with similar or varying shapes and sizes are within the scope of the disclosure. The apparatus, methods, and articles of manufacture described herein are not limited in this regard.

Figure 3:
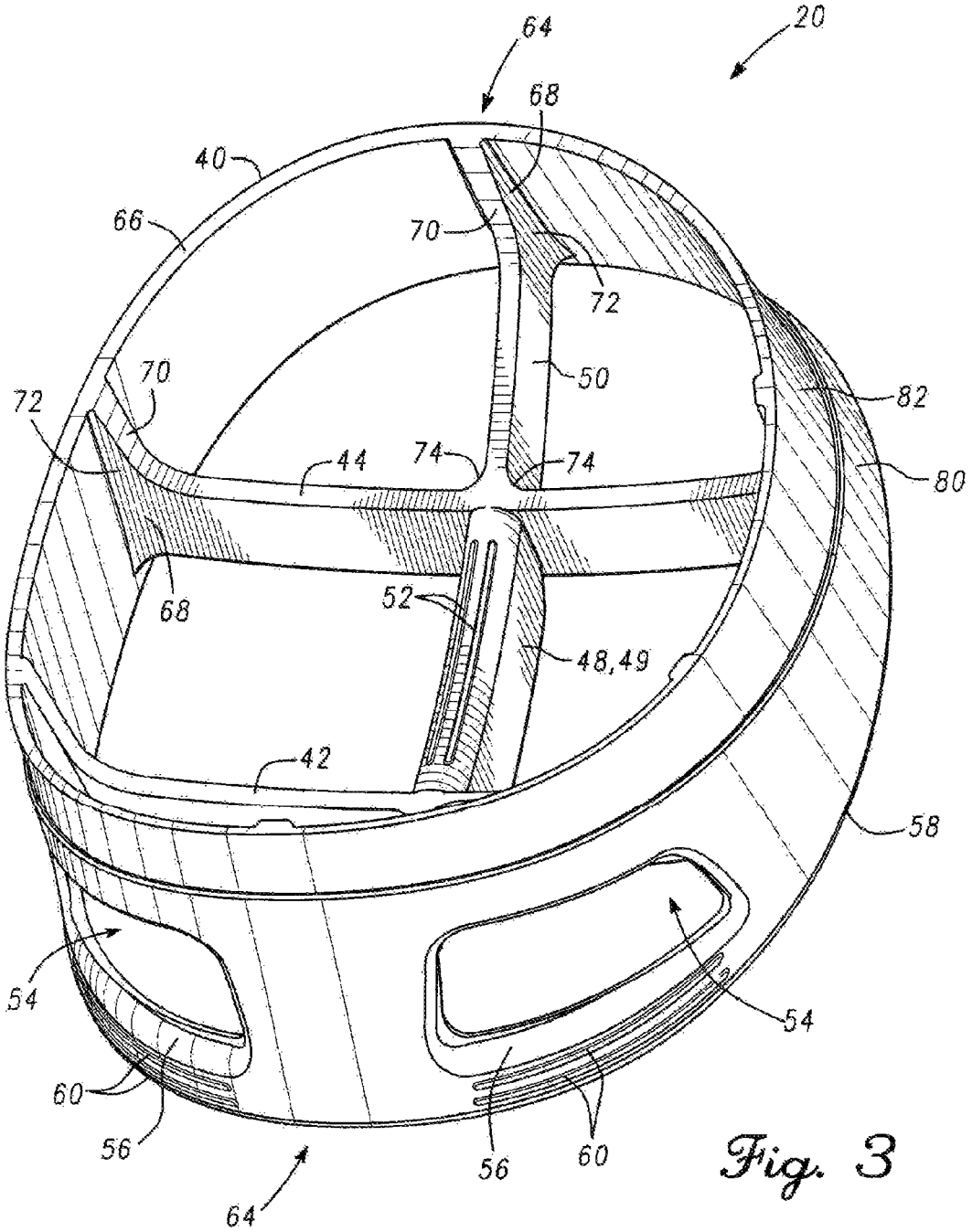
FIG. 3 shows a bottom perspective view of the top divider of FIG. 2.
Figure 5:
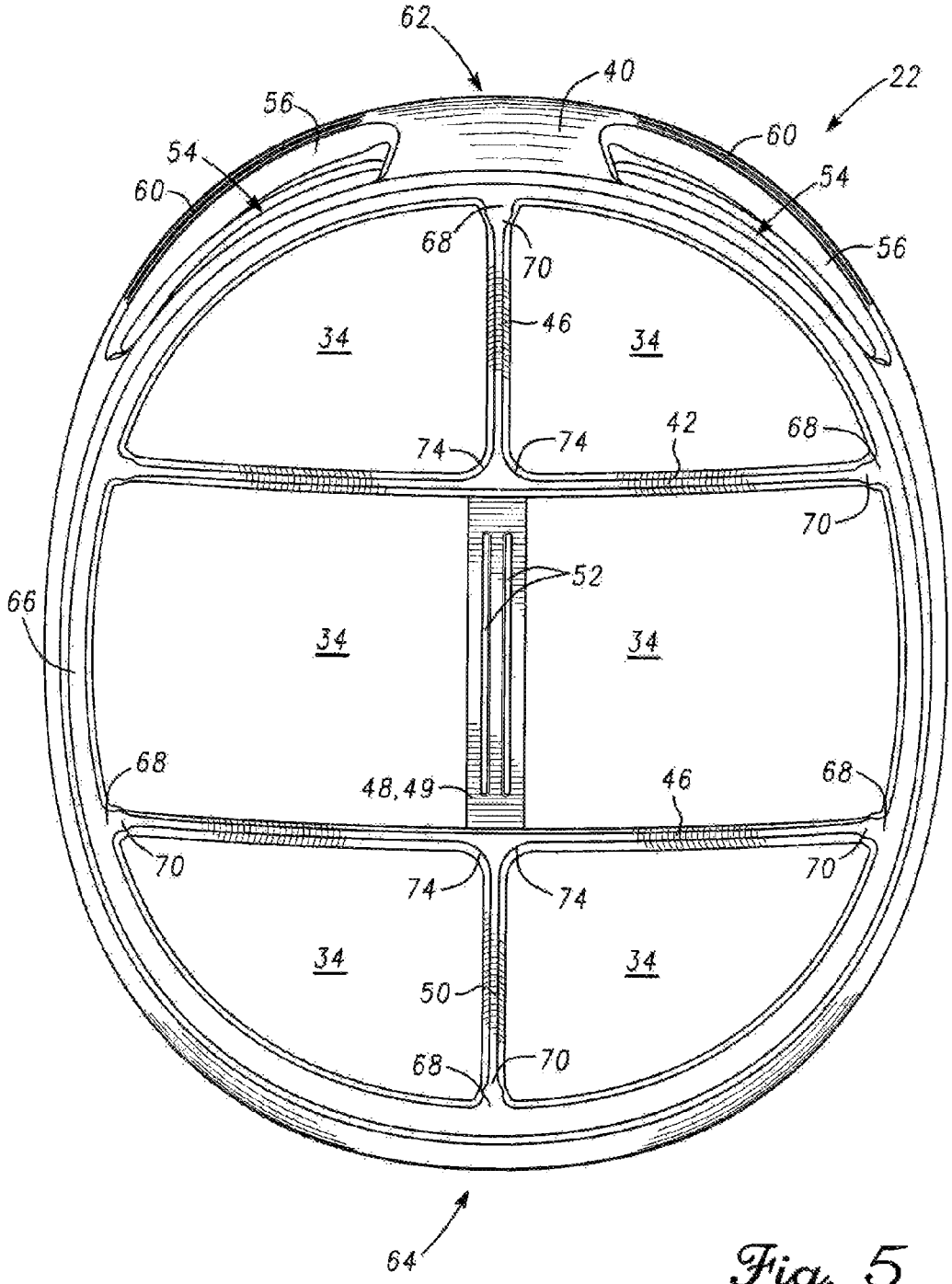
FIG. 5 shows a bottom view of the top divider of FIG. 2.

The longitudinal rib 48 may also functions as a handle 49 to allow the carrier to shift, lift and/or move the golf bag 20. To reduce or prevent any discomfort that may be experienced by the carrier when carrying the golf bag 20 with the handle 49, the longitudinal rib 48 may be thicker and/or generally larger than the longitudinal ribs 46 and 50. Accordingly, the handle 49 may provide a better grip for the carrier and provides a larger surface area by which the weight of the golf bag 20 can be distributed onto the palm and the fingers of the carrier's hand. Although not shown, the handle 49 may be contoured and/or have a plurality of depressions that generally correspond to the shape of a carrier's fingers when holding the handle 49. Furthermore, any part a the handle 49 may include a textured surface or other types of surface characteristics for providing a better grip and comfort for the carrier. For example, as shown in FIGS. 3 and 5, the handle 49 may include a plurality of elongated projections 52 that form a ribbed surface to provide a better frictional grip for the carrier. The projections 52 may be formed from a soft material such as rubber to also provide a comfortable grip for the carrier. Portions or the entire handle 49 may be covered with a soft and/or elastic material to provide comfort to the carrier. For example, the handle 49 may be coated or covered by a foam material, rubber or the like. The apparatus, methods, and articles of manufacture described, herein are not limited in this regard.

The handle 49 may be sized to be larger than the width of a carrier's hand to allow the carrier to grab the handle 49 for shifting, moving and/or lifting the golf bag 20. The handle 49 may be sized for an individual with very large hands so as to be usable by any individual with smaller sized hands. Alternatively, the handle 49 may be sized based on the size of the golf club bag 20. For example, a small golf club bag that is designed for use by a child may have a smaller handle 49 than a golf bag that is designed for use by an adult. Alternatively yet, the handle 49 may be sized to fit a particular individual. The apparatus, methods, and articles of manufacture described herein are not limited in this regard.

Figure 9:
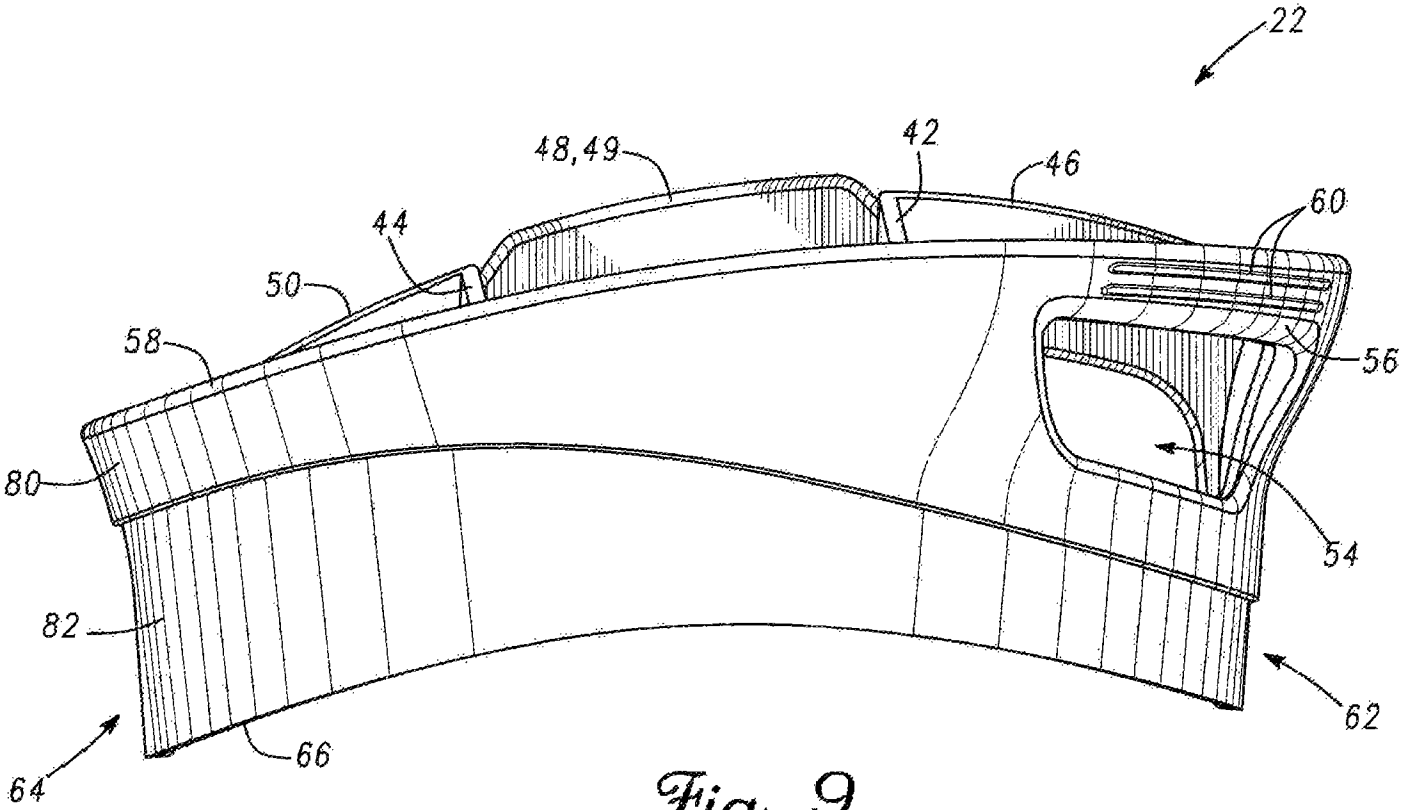
FIG. 9 shows a side view of the top divider of FIG. 2 viewed from the opposite side of FIG. 8.
Figure 10:
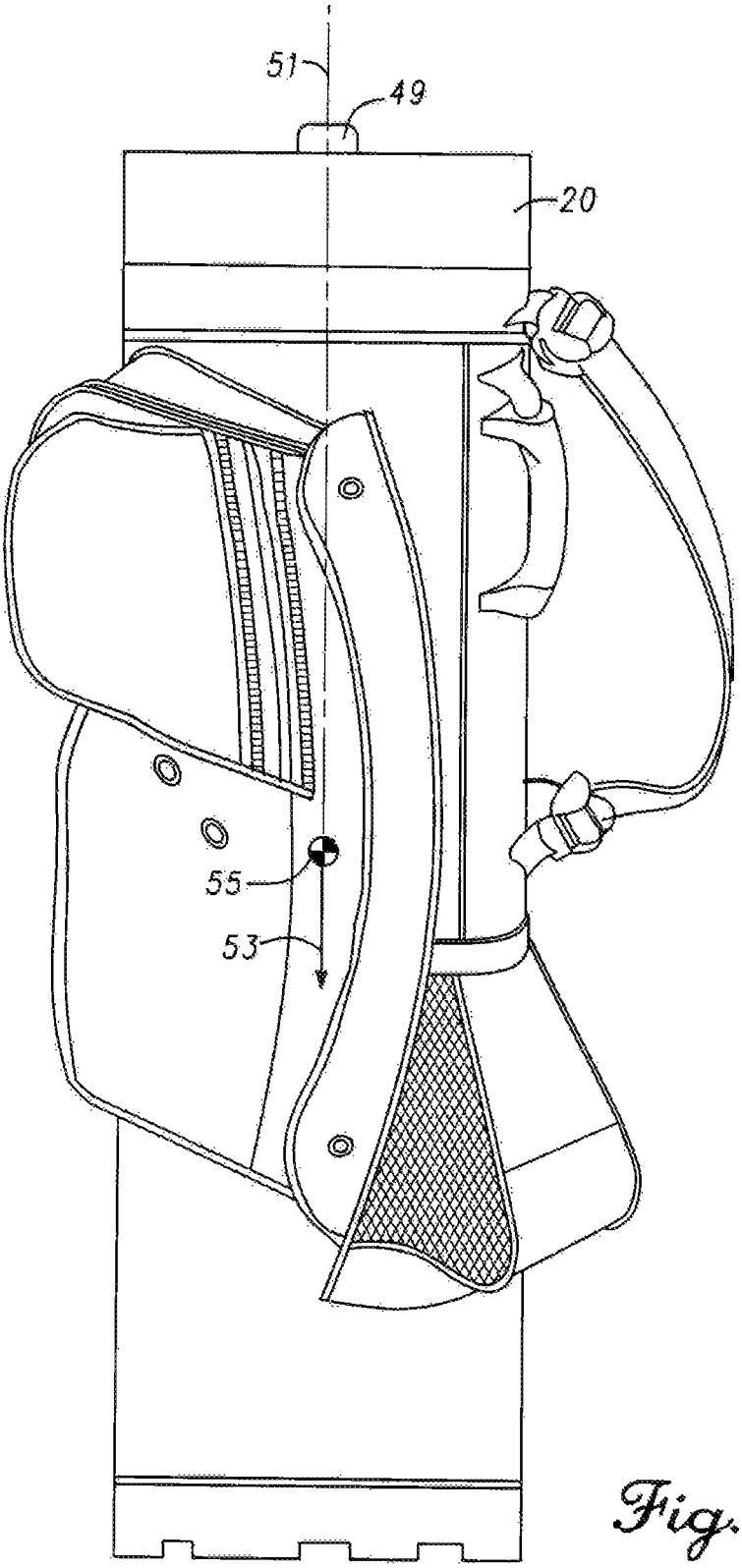
FIG. 10 shows a schematic diagram of a golf bag according to one embodiment.

Referring to FIG. 10, at least a portion of the handle 49 may be located on an axis 51 of the golf bag 20 that defines a vector 53 extending from a center of gravity 55 of the golf bag 20 and representing the weight of the golf bag 20. Therefore, when the golf bag 20 is lifted by a carrier with the handle 49, the golf bag 20 may be in a balanced or nearly balanced position. As a result, the golf bag 20 may not rotate about the handle 49 and maintains its vertical position. The balanced handling of the golf bag 20 provided by the position of the handle 49 allows the carrier to shift, lift and move the golf bag, especially when the golf bag is heavily loaded, without any swinging or rotation of the golf bag 20. In the disclosed examples, as shown in FIG. 10, the axis 51 may generally pass through the center of the open top 32 of the golf bag 20. Accordingly, as shown in FIGS. 2-9, at least a portion of the handle 49 may be located at the center or approximately at the center of the open top 32 divider 22. However, for a golf bag having an off-center center of gravity due to for example the shape of the bag, the handle 49 may be correspondingly off center relative to the divider 22 to provide the disclosed, balanced handling of the golf bag. The apparatus, methods, and articles of manufacture described herein are not limited in this regard.

Figure 11:
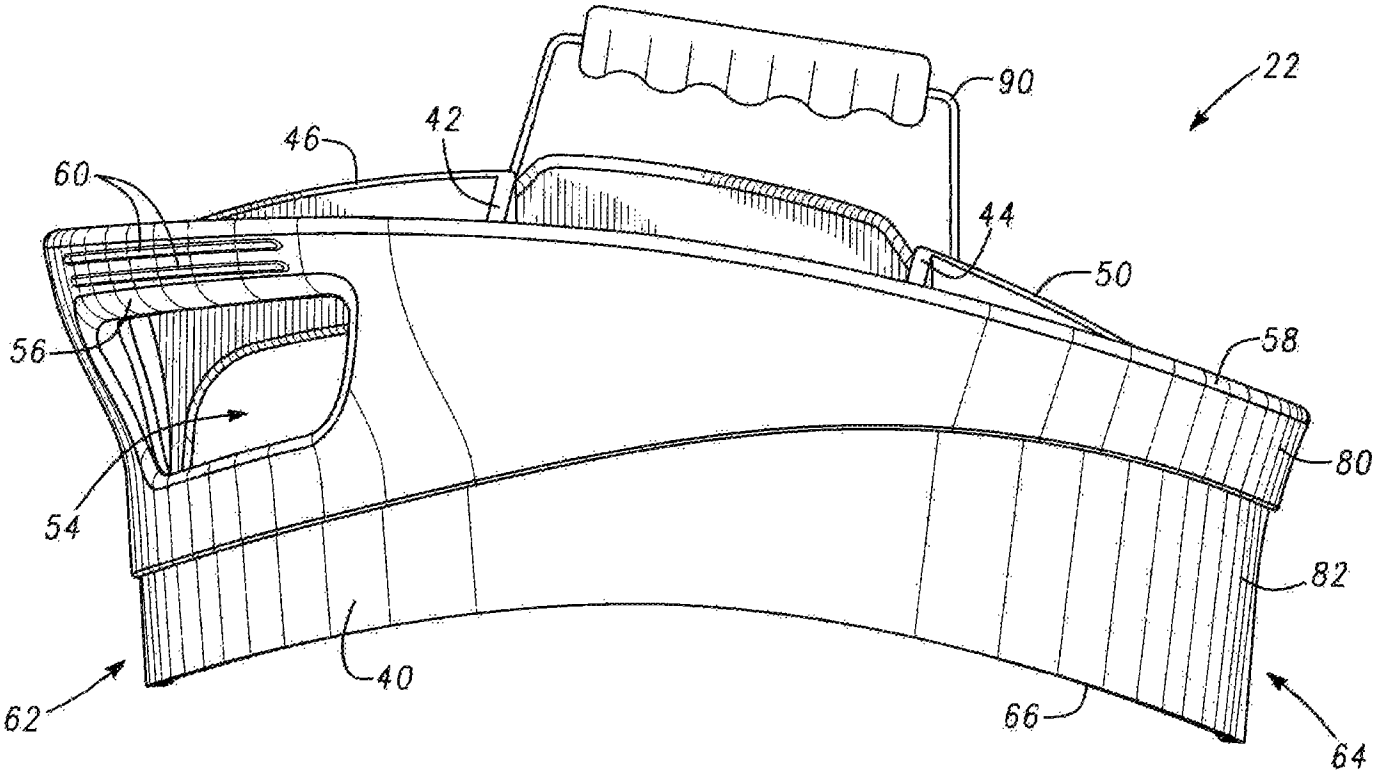
FIG. 11 shows a side view of a top divider according to another embodiment.

While the above example may describe the handle 49 as an integrated portion of the top divider 20, the handle 49 may be a separate portion that is removably attached or affixed to the top divider 22. For example, the handle 49 may be customized or selected from a plurality of handles to custom fit an individual's hand size (e.g., small, medium, large, child, adult, etc.), which may provide a better grip. In another example shown in FIG. 11, the handle may be defined by a strap 90 that is attached to the rib 48 or any of the other ribs 42, 44, 46, 48, and 50. The strap 90 may be positioned at a location on the top divider 22 so that at least a portion of the strap passes through or nearly pass through the vector 53 that represent the weight of the golf bag 20 and passes through the center of gravity 55 of the golf bag 20. The apparatus, methods, and articles of manufacture described, herein are not limited in this regard.

According to one example, the top divider 22 may include one or more handles 56 positioned on the perimeter section 40. Each handle 56 may be in any configuration. For example, a handle 56 may be a projecting loop, a strap or the like. According to one example as shown in FIGS. 2-9, the top divider 22 includes two apertures 54, which define two handles 56 in cooperation with the upper rim 58 of the perimeter section 40. Each of the apertures 54 may be sized to allow a carrier of the golf bag to insert at least some of his or her fingers through the aperture. In one example, the apertures 54 may be sized to allow a carrier to insert his or her fingers from the index finger to the little finger through the aperture (e.g., four fingers). The apertures 54 may be sized for an individual with very large hands so as to be usable by an individual with smaller hands. Alternatively, the apertures 54 may be sized based on the size of the golf club bag 20. For example, a small golf club bag that is designed for use by a child may have smaller apertures 54 than a golf bag that is designed for use by an adult. Alternatively yet, the apertures 54 may be sized for a particular individual. In other embodiments, the apertures 54 may have different sizes and shapes. Although the above example may describe two handles 56, the golf bags and top dividers described herein may include more or less handles at or proximate to the perimeter section 40. The apparatus, methods, and articles of manufacture described herein are not limited in this regard.

To use one of the handles 56, the carrier of the golf bag can insert his fingers from his index finger to his little finger through the corresponding aperture 54 from outside the perimeter section 40. The carrier can then wrap his fingers around the handle 56 to grip the handle 56 and shift, lift and/or move the golf bag 20. Although not shown, the handles 56 may be contoured and/or have a plurality of depressions corresponding to a carrier's fingers. Furthermore, any part of the handles 56 may include a textured surface or have other types of surface characteristics for providing a better grip and comfort for the carrier. For example, as shown in FIGS. 2, 3, 5, 6, 8 and 9, the outer surface of the handles 56 may include a plurality of elongated projections 60 that form a ribbed surface to provide a better frictional grip for the carrier. The projections 60 may be constructed from a soft material such as rubber to provide comfortable grip for the carrier. Alternatively, portions or the entire handle 56 may be covered and/or coated with soft material such as rubber.

Each of the handles 48 and 56 can be used alone or in combination. Because the handles 56 are on the perimeter section 40, the handles 56 may be easier to use in tight or constricted spaces as compared to the handle 49. Such constricted spaces may include a locker room, a tee box, or the edge of a green. For example, when the carrier of the golf bag 20 wants to place the golf bag 20 in a locker, the golf bag 20 can be lifted with either the handle 49 and/or the handles 56 and placed at the edge of the locker with the handles 56 facing outward. The handles 56 can then be used to lift and push the golf bag 20 or just push the golf bag 20 completely inside the locker. To remove the golf bag 20 from the locker, the handles 56 can be used to pull the golf bag 20 out of the locker. The carrier can then lift the golf bag 20 with the handle 49 and/or the handles 56. Additionally, a carrier can use one or both of the handles 56 to lay the golf bag 20 down on its side. Similarly, when lifting the golf bag to an upright position, the carrier can grab one or both of the handles 56 to accomplish such lifting task. Thus, each of the handles 49 and 56 when used alone or in combination can provide the carrier with a variety of options for shifting, lifting and/or moving the golf bag 20 depending on the position of the bag, certain space restrictions, the weight of the golf bag 20 and/or other factors.

Figure 8:
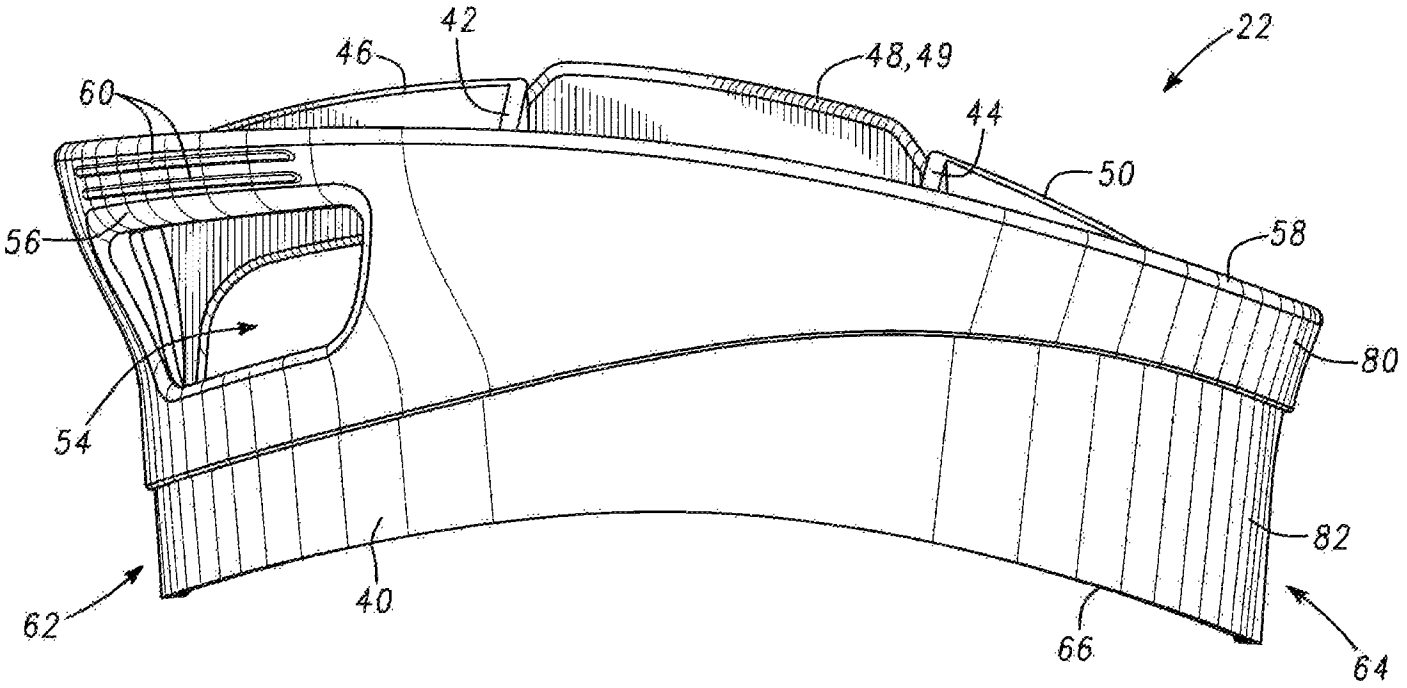
FIG. 8 shows a side view alone side of the top divider of FIG. 2.

FIGS. 8 and 9 show side views of the top divider 22. The curvature of the perimeter section 40 as viewed from the side of the top divider 22 may correspond to the side curvature of the open top 32 of the golf bag 20. A front end 62 of the perimeter section 20 may be positioned higher than the back end 64 of the perimeter section 20, thereby defining a downwardly sloping curvature of the perimeter section 40 from the front end 62 to the back end 64.

The upper rim 58 may have a larger diameter than the lower rim 66 to provide an open top end 32 for the golf bag that is larger than the internal diameter of the body 24 of the golf bag 20. As shown in FIGS. 8 and 9, the perimeter section 40 transitions from the lower rim 66 to the upper rim 58 with an outwardly sloping curvature. The larger diameter of the upper tint 58 relative to the diameter of the lower rim 66 provides an open top end 32 that is larger in diameter than the internal diameter of the golf bag 20. Accordingly, the larger open top 32 provides larger slots 34 and may facilitate easier insertion of golf clubs into the golf bag 20.

Figure 6:
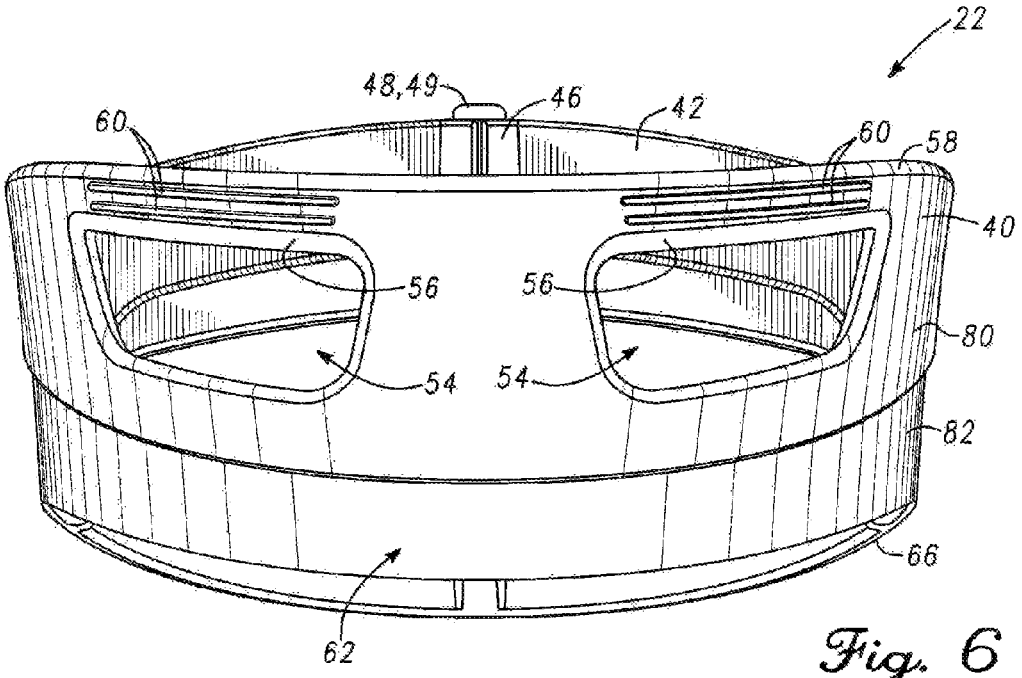
FIG. 6 shows a front view of the top divider of FIG. 2.
Figure 7:
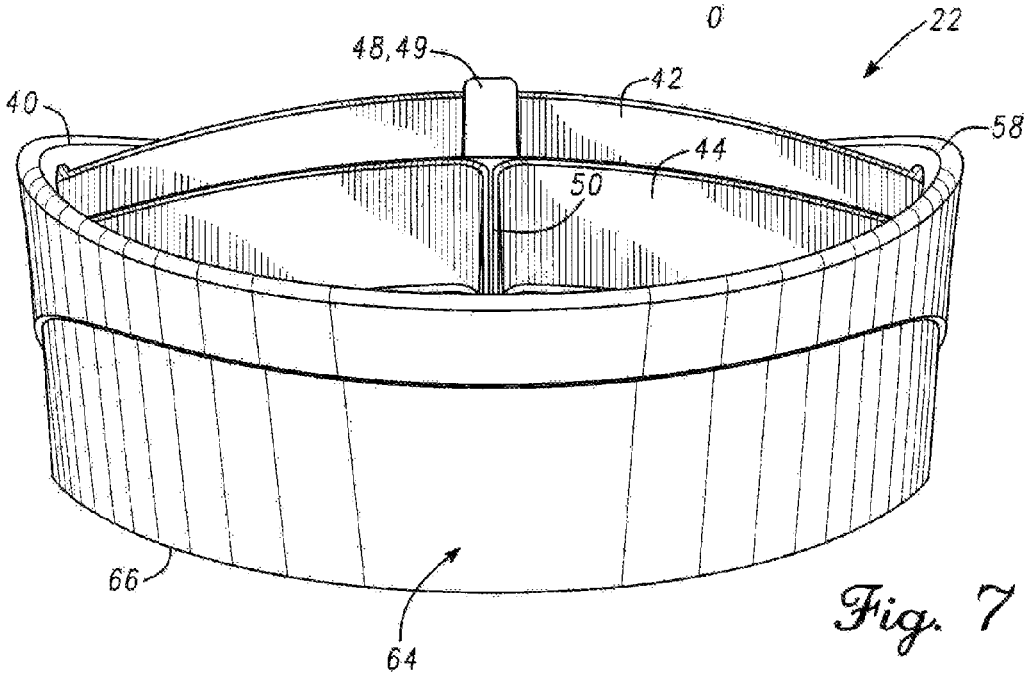
FIG. 7 shows a rear view of the top divider of FIG. 2.

FIGS. 6 and 7 show front and back views of the top divider 22. The perimeter section 40 may be wider at the front end 62 than at the back end 64. Accordingly, sufficient space may be provided on the perimeter section 40 for placing the handles 56.

Figure 4:
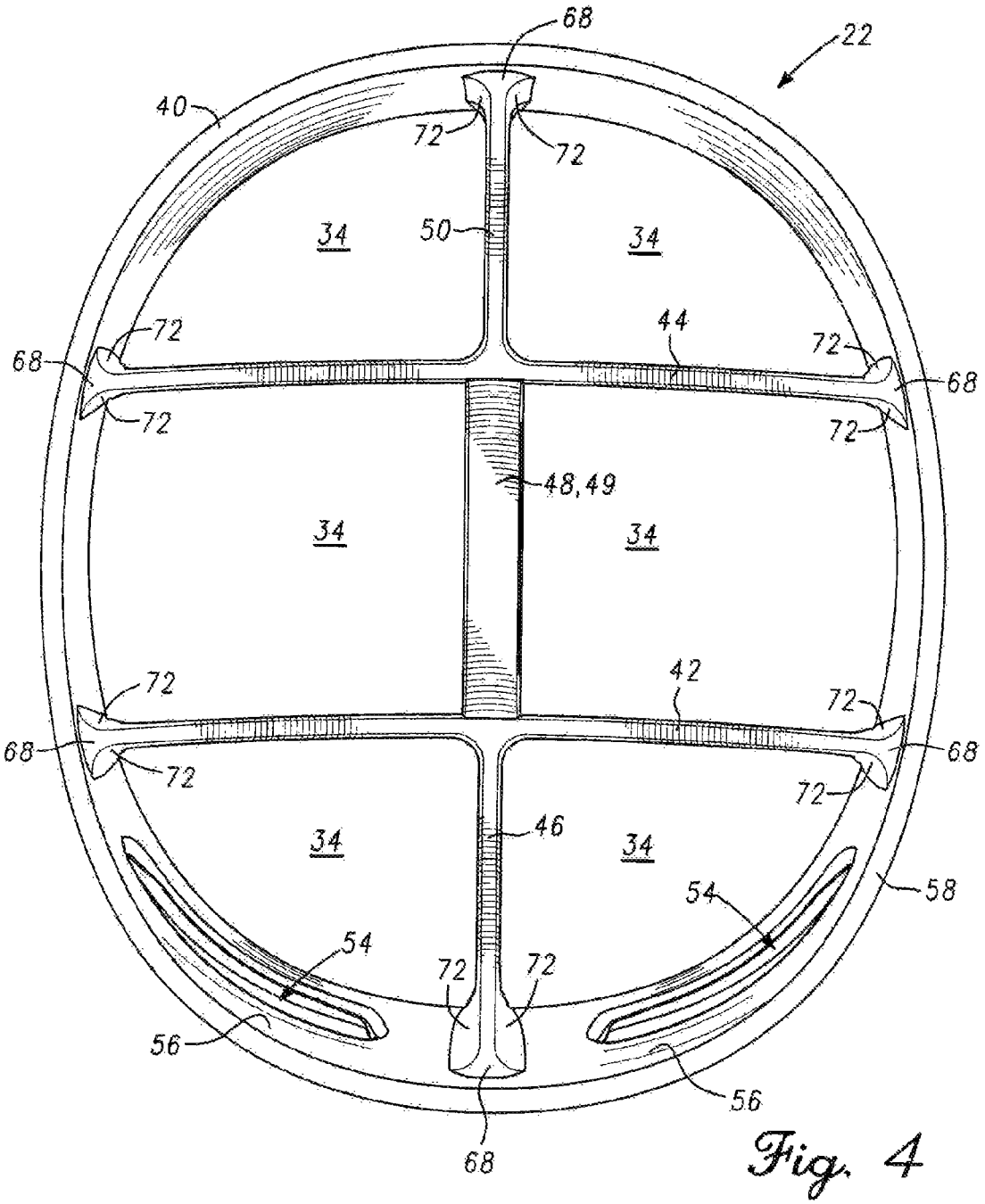
FIG. 4 shows a top view of the top divider of FIG. 2.

FIGS. 4 and 5 show top and bottom views of the top divider 22. The lateral ribs 42 and 44 are shown to be generally straight. Furthermore, the handle 49 is shown to be longer than the ribs 46 and 50 to provide sufficient space for the carrier's hand when the carrier is grabbing the handle 49. Accordingly the ribs 42 and 44 and the handle 49 define two slots 34 (i.e., the middle slots) that are larger than the remaining slots 34 of the top divider 22. However, the ribs 42 and 44 can be formed to have curved shapes to provide different sizes for the slots 34. For example, if the ribs 42 and 44 are formed concave relative to the handle 49, the slots 34 on the sides of the handle 49 become smaller than the same slots shown in FIGS. 4 and 5. Conversely, if the ribs 42 and 44 are formed convex relative to the handle 49, the slots 34 on the sides of the handle 49 become larger than the same slots shown in FIGS. 4 and 5. Thus, the curvature of the ribs 42 and 44 may affect the size of the slots 34.

Referring to FIGS. 8 and 9, the handle 49 is positioned such that at least all or portions thereof are located above the upper rim 58 of the perimeter section 40. Accordingly, the handle 49 may be easily identifiable and accessible by the carrier of the golf bag 20. Furthermore, the higher position of the handle 49 may reduce interference with the carrier's hand, wrist and/or forearm from the remaining sections of the top divider 22 when the carrier reaches for the handle 49, grabs the handle 49, and uses the handle 49. To elevate the handle 49 relative to the remaining parts of the top divider 22, the ribs 42-50, which include the handle 49 may be upwardly sloped from the perimeter section 40 toward approximately the center of the perimeter section 40, which in the disclosed example is the location of the handle 49. Thus, the grid-like formation of the ribs 42-50 is at least slightly dome-shaped to place the handle 49 at the top of the dome-shaped grid and above the upper rim 58.

Referring to FIGS. 2-5, the ends of the ribs 42 and 44, and one end of the ribs 46 and 50 are connected to the perimeter section 40 with connection sections 68. The connection sections 68 may be sections that provide a transition from the ends of the ribs to the inner wall of the perimeter section 40 to increase structural rigidity and reduce stress concentration areas at the noted connections. Accordingly, the connection sections 68 may provide a curved or chamfered transition 70 from the lower edge of the corresponding rib to the inner wall of the perimeter section 40. Additionally, the connection section 68 may provide a curved or chamfered transition 72 from the side edges of the corresponding rib to the surface of the inner wall of the perimeter section 40. Thus, as shown in FIGS. 2-5, each of the connection sections 68 may appear to be a continuous part of the corresponding rib and/or the inner wall of the perimeter section 40. The lateral ribs 42 and 44 and the longitudinal ribs 46 and 50 may be connected together with curved or chamfered transitions 74 to increase structural rigidity and reduce stress concentration areas at the noted connections.

The lateral ribs 42 and 44 and the longitudinal ribs 46 and 50 may have the same or different thicknesses and widths. In the embodiments of FIGS. 4 and 5, the thicknesses and widths of these ribs are shown to be similar. However, the thicknesses and the widths of the lateral ribs 42 and 44 may be greater than the thicknesses and/or widths of the ribs 46 and 50. For example, the thicknesses and widths of the lateral ribs 42 and 44 may be increased while reducing the thicknesses and/or widths of the ribs 46 and 50 without affecting the structural strength characteristics, of the top divider 22.

Referring to FIGS. 2, 3 and 6-9, the perimeter section 40 may include an upper section 80 and a lower section 82. Referring to FIG. 1, the upper section 80 may extend above the body 24 of the golf bag 20 while the lower section 82 is inside the body 24. The lower section 82 may be thinner than the upper section to allow insertion thereof inside the body 24 and attachment thereof at the open top end 32 of the golf bag 20. Furthermore, the upper section 80 may be thicker than the lower section 82 so that after the top divider 22 is attached to the golf bag 20, the outer surface of the upper section 80 is substantially flush with the outer surface of the body 24 at the open top 32.

Although the figures may depict a particular example configuration for a top divider (e.g., symmetrical along the longitudinal ribs 46, 48, and 50), the golf bags and top dividers described herein may include other configurations. The top divider 22 may be asymmetrical along the longitudinal rib 48 and/or other ribs. While the figures may also depict a particular number of ribs, slots, and handles, the golf bags and top dividers described herein may include more or less number of ribs, slots, and/or handles. Further, the ribs 42, 44, 46, 48, and 50, slots 34, and handles 49 and 56 may be located in other locations of the top divider 22. The apparatus, methods, and articles of manufacture described herein are not limited in this regard.

Figure 12:
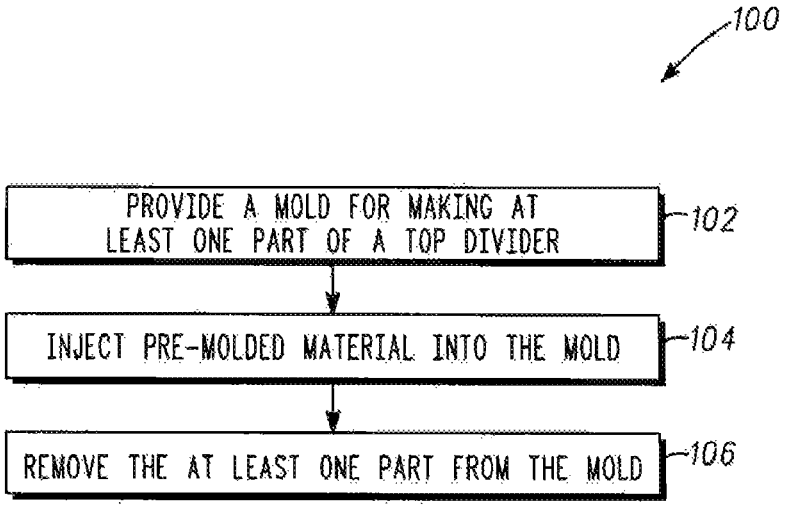
FIG. 12 shows a method of making a top divider according to one embodiment.

The top divider 22 may be constructed in one piece by being constructed from plastic, metal, composite materials, wood or a combination thereof. The top divider 22 may be formed by injection molding or similar methods. Referring to FIG. 12, a method 100 of forming the top divider with injection molding is shown. With injection molding, a one-piece or a multi-piece mold can be constructed which has interconnected cavities corresponding to the above-described interconnected parts of the top divider 22. The method 100 includes providing a mold for making at least one part of the top divider (block 102). Molten material, such as molten plastic or metal is injected into the mold (block 104), which is then cooled. The top divider 22 is then removed from the mold (block 106) and may be machined, to smooth out irregularities on the surfaces thereof or to remove residual parts.

As described, above, the perimeter section 40 expands upwardly from the lower rim 66 to the upper rim 58. This expansion provides a draft angle so that that top divider 22 can be removed from the mold. Furthermore, various curved surfaces of the top divider 22 as described in detail above may provide easier injection and cooling of the plastic material that forms the top divider 22, reduce material irregularities in the molded top divider 22 at the areas where the ribs are connected to the perimeter section and to each other, and easier removal of the top divider 22 from the mold.

The divider 22 may be manufactured in separate pieces or in one piece by stamping (i.e., punching using a machine press or a stamping press, blanking, embossing, bending, flanging, or coining, casting), injection molding, forging, machining or a combination thereof, or other processes used for manufacturing metal, composite, plastic or wood parts. If the divider 22 is manufactured in separate pieces, the divider 22 may be constructed by attaching the separate pieces by fasteners, adhesives, bonding, welding or any other attachment method that may be suitable for the material from which the pieces are manufactured.

After forming the top divider 22, various parts thereof may be coated with other materials to provide texture, color, or other physical and aesthetic characteristics. For example, the handle 49 and the handles 56 may be coated, with a rubber material after injection molding the top divider 22. The rubber material may provide a softer yet a better frictional grip for the carrier when using the handles. Upon forming the top divider 22 as described above, the top divider 22 can be attached to the golf bag 20 at the open top end 32. The top divider 22 can be attached to the inner wall of the golf bag with adhesive, rivets, fasteners or other attachments devices and methods. Various sections of the top divider 22, such as the ribs 42-50 can be covered with the same fabric that covers the interior of the bag so as to give the top divider 22 a uniform appearance with the interior of the golf bag 20. The fabric may also provide padding for the ribs 46-50 and the perimeter section 40.

The material from which the top divider 22 is constructed and/or the continuous one-piece construction of the top divider 22 may provide sufficient rigidity to not only maintain the shape of the golf bag when in an upright position, but also to provide support for the carrier when the golf bag 20 is laid down on the ground and the carrier sits on the golf bag 20. The above-described oval-shaped perimeter section 40, the curved shapes of the various parts of the top divider 22 such as the ribs 46-50, the connection sections 68, the interconnectedness of the above-described parts, and the material from which the top is constructed collectively provide sufficient rigidity and structural strength for the top divider 22 such that the top can be subjected to the static and dynamic loads encountered daring typical use. Accordingly, the top divider 22 may function as a primary structural support for the top portion of the golf bag 20 such that other typical structural supports, for the top portion of the golf bag 20 may not be required. Therefore, the top divider 22 may replace any structural support members at the top portion of the golf bag 20. Alternatively, the top divider 22 may provide structural support for the top portion of the golf bag 20 in addition to any other structural support near or at the top portion.

The top divider 22 may be constructed by forming the perimeter section 40 and the ribs 42-50 separately and then attaching these parts together. For example, the perimeter section 40 may be formed by injection molding as described above. The ribs 42-50 including the connection sections 68 may be also formed by injection molding. The connection sections 68 can then be attached to the perimeter section 40 with an adhesive, rivets, fasteners, or other methods that can provide the same or better structural characteristics as the one-piece injection molding of the top divider 22 as described above. In other embodiments, the top divider 22 may be constructed by machining. The materials of the top divider 22 are not limited to plastics and may include wood, metal or composite materials, such as fiberglass or graphite. Depending on the material(s) used for the entire or parts of the top divider 22, a variety of methods can be used to manufacture and/or assemble the top divider 22.

Figure 13:
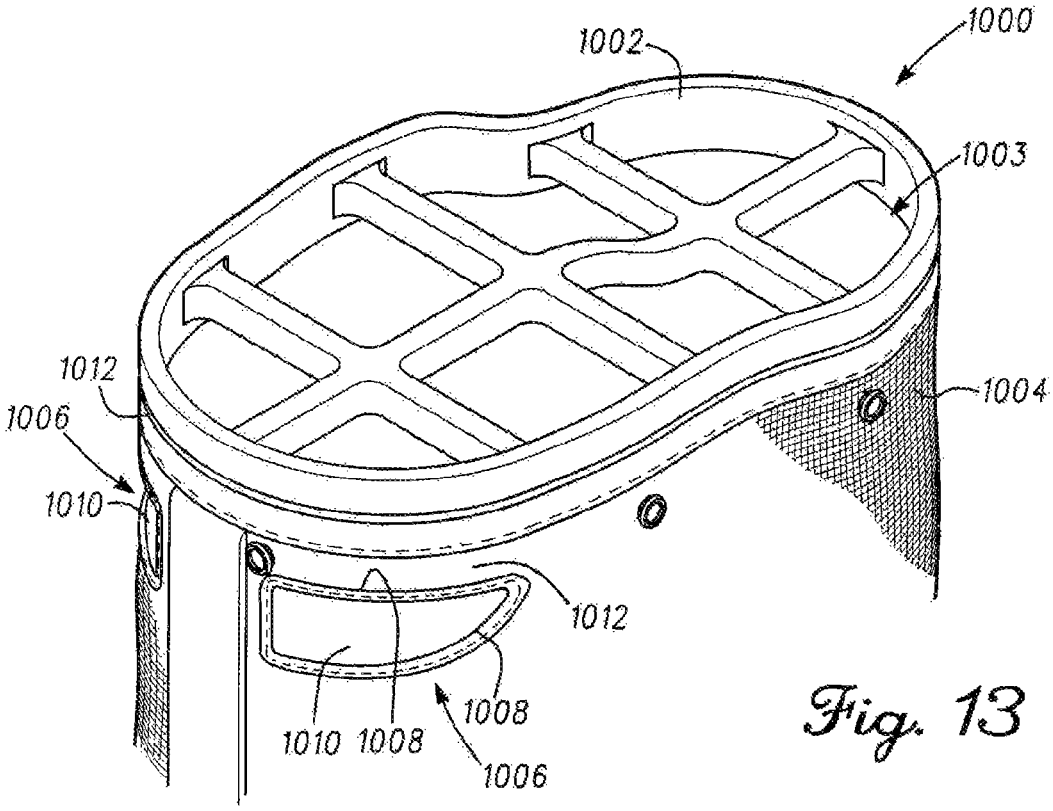
FIG. 13 shows a golf bag according to one embodiment.
Figure 14:
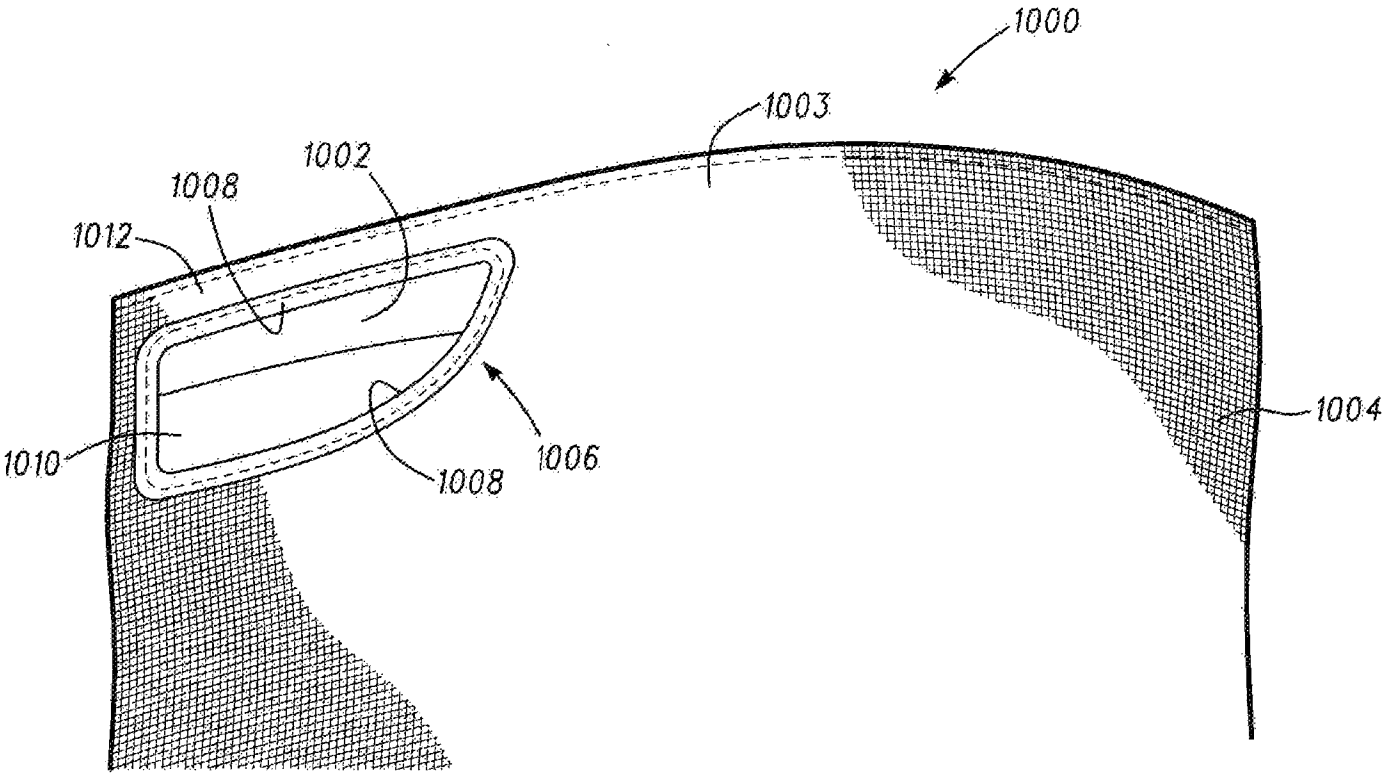
FIG. 14 shows a golf bag according to one embodiment.

Referring to FIGS. 13 and 14, a golf bag 1000 according to another example is shown. The golf bag 1000 includes a top divider 1002 that is attached to the open top 1003 of the body 1004 of the golf bag 1000. The top divider 1002 may be any type of top divider or top divider structure including a top divider according to the disclosure. The body 1004 includes at least one handle 1006 that may be defined by an aperture on the body. The handle 1006 may be sized to receive all or portions of an individual's hand. Additionally, the handle 1006 may have any shape such as a rectangular, triangular, oval, teardrop, circular or any combination thereof. However, the handle 1006 may be ergonomically shaped to generally evenly distribute the weight of the golf bag 1000 on an individuals hand. For example, the handle 1006 may include a rim 1008 that is curved or has a certain, contour that generally corresponds to the shape of an individual's hand when gripping the handle 1006. The handle 1006 may also include a rim having finger indentations for receiving an individual's fingers. Furthermore, the handle 1006 may be include a rim that is padded to provide a comfortable hold for an individual's hand and/or fingers.

The golf bag 1000 may include any number of handles 1006. For example, the golf bag 1000 may include two handles 1006, where each handle 1006 is positioned on the golf bag 1000 opposite to the other handle (shown in FIG. 13). Accordingly, an individual can reach and grab any of the handles 1006 regardless of the position of the individual relative to the bag. The handle 1006 or a plurality of handles 1006 may be located anywhere on the body 1004. In the example of FIG. 13, a pair of handles 1006 (only one handle 1006 is shown) is positioned near the top divider 1002, hence near the open top 1003 of the golf bag 1000. Accordingly, the handles 1006 may be easily accessible by a person standing adjacent the golf bag 1000.

The handle 1006 may be defined by an aperture located anywhere on the body 1004. For example, one or more handles 1006 may be located near the middle section of the body. In the examples of FIGS. 13 and 14, the handle 1006 is near the open top 1003 such that the handle 1006 is defined by an aperture 1010 and a top rim 1012 of the body 1004. The top rim 1012 is positioned between the aperture 1010 and the open top 1003. To use the handle 1006, an individual can insert his or her hand inside the aperture 1010 and wrap his or her hand around the top rim 1012 to grip the top rim 1012 for shifting, moving and/or lifting the golf bag 1000. The top rim 1012 may be padded and/or contoured to provide an comfortable grip for an individual. Furthermore, the top rim 1012 may have a certain type of surface texture (not shown) to frictionally enhance an individual's grip. Because the handle 1006 are on the body 1004, rather than projecting out of the body 1004, the handle 1006 may be easier to use in tight or constricted spaces as compared to a handle that is attached to the body 1004 and/or projects out of the body 1004. Such constricted spaces may include a locker room, a tee box, or the edge of a green.

The handle 1006 may be formed on the body 1004 by forming an aperture on the body corresponding to the size, the shape and other configuration of the handle. For example, if the body is constructed from leather, the shape of the handle 1006 may be cut out of the leather used to construct the body before or after the body 1004 is formed. The handle 1006 may also be cut out of any internal layers of the body, such as any framing layer, backing sheets or layers and/or any bag support structure. The apparatus, methods, and articles of manufacture described herein are not limited in this regard.

Although a particular order of actions is disclosed, these actions may be performed in other temporal sequences. For example, two or more actions may be performed sequentially, concurrently, or simultaneously. Alternatively, two or more actions depicted may be performed in reversed order. Further, one or more actions may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A golf bag comprising:

a body (1004) comprising a hard shell, having a closed bottom, and an open top (1003) and defining an interior space between the open top (1003) and the closed bottom for storing golf clubs, the open top (1003) defining an upper rim (1012) of the body (1004);

a top divider (1002) comprising a plurality of ribs coupled adjacent to the open top (1003), the top divider (1002) defining a plurality of slots configured to receive one or more golf clubs;

a first aperture (1010) extending through the body (1004) proximate to the open top (1003) and into the interior space, the first aperture (1010) defined below the upper rim (1012) of the body (1004);

a first handle (1006) defined by the first aperture (1010) of the body (1004) and a portion of the upper rim (1012) of the body (1004);

a second aperture (1010) extending through the body (1004) proximate to the open top (1003) and into the interior space, the second aperture (1010) defined below the upper rim (1012) of the body (1004); and a second handle (1006) defined by the second aperture (1010) of the body (1004) and a portion of the upper rim (1012) of the body (1004);

wherein;

a side handle (27) is affixed to an exterior portion of the body (1004);

the first and second handles (1006) are opposingly positioned along a portion of the open top (1003) above the side handle (27);

each of the first and second handles (1006) is configured to support a weight of the golf bag when the golf bag is lifted by the first or second handle (1006), and each of the first and second handles having a horizontal extent being greater than a vertical extent; and each of the first or second handles (1006) is configured such that a carrier of the golf bag can insert his fingers from his index finger to his little finger through the first or second aperture (1010) and wrap his fingers around the first or second handle (1006) to grip the first or second handle (1006) and make contact with said top divider; and wherein the top divider (1002) is a separate element from the body (1004), and the first and second apertures (1010) are formed as part of the body (1004) below a top edge of the body (1004) and below the top divider (1002).

2. The golf bag according to claim 1, wherein a top end of the body (1004) is configured to support a weight of an individual when the golf bag (1000) is in a generally horizontal position.

3. The golf bag of claim 1, wherein the upper rim (1012) of the body (1004) comprises a barrier between the first aperture (1010) and the top divider (1002).

4. The golf bag of claim 1, wherein the first and second handles (1006) do not project away from the body (1004).

5. A golf bag, comprising:

a body (1004);

a top divider (1002) coupled to a top edge of the body (1004) with the top divider (1002) being a separate element from the body (1004);

a first aperture (1010) formed as part of the body (1004) below the top divider (1002) with an upper rim (1012) of the body (1004) between the top divider (1002) and the first aperture (1010);

a second aperture (1010) formed as part of the body (1004) below the top divider (1002) with the upper rim (1012) of the body (1004) between the top divider (1002) and the second aperture (1010);

a first handle (1006) defined by the first aperture (1010) and a portion of the upper rim (1012);

a second handle (1006) defined by the second aperture (1010) and a portion of the upper rim (1012); and each of the first and second handles having a horizontal extent being greater than a vertical extent such that fingers of a user can grab onto one of the first and second handles and make contact with said top divider.

6. The golf bag of claim 5, wherein the upper rim (1012) of the body (1004) comprises a barrier between the first aperture (1010) and the top divider (1002).

7. The golf bag of claim 5, wherein the first and second handles (1006) do not project away from the body (1004).

* * * * *